United States Patent [19]

Remington et al.

[11] 4,363,226

[45] Dec. 14, 1982

[54] LATCHING SYSTEM FOR LUGGAGE ARTICLES

[75] Inventors: Richard C. Remington, Pompton Plains; Lazlo Bako, Woodcliff Lake, both of N.J.

[73] Assignee: Presto Lock, Inc., Garfield, N.J.

[21] Appl. No.: 200,000

[22] Filed: Oct. 23, 1980

[51] Int. Cl.[3] ..... E05B 65/52; E05B 37/02

[52] U.S. Cl. ..... 70/70; 70/312; 70/DIG. 42; 292/28

[58] Field of Search ..... 70/67-76, 70/312, DIG. 42; 292/25-26, 29, 45-48, 53, 28, 38, DIG. 62

[56] References Cited

U.S. PATENT DOCUMENTS

| | | | |
|---|---|---|---|
| 928,904 | 12/1909 | Cottrell . | |
| 2,238,480 | 4/1941 | Tierney | 292/28 |
| 3,135,105 | 8/1964 | Brody | 70/71 |
| 3,498,657 | 3/1970 | Fontana | 70/70 |
| 3,555,860 | 3/1971 | Atkinson | 70/312 |
| 3,646,612 | 2/1972 | Anderson | 292/DIG. 62 |
| 3,875,772 | 7/1975 | Ebersman et al. | 70/107 |
| 3,961,505 | 9/1976 | Gehrie et al. | 70/66 |
| 4,123,923 | 9/1978 | Bako | 70/74 |

FOREIGN PATENT DOCUMENTS

| | | | |
|---|---|---|---|
| 17539 | 3/1980 | European Pat. Off. | 70/71 |

*Primary Examiner*—Robert L. Wolfe

*Attorney, Agent, or Firm*—Shapiro and Shapiro

[57] ABSTRACT

A latching system for a luggage article comprises a pair of spaced swiveling latches mounted on the interior of a front wall of the article, the latches being connected together for swiveling movement in unison between latching and unlatching positions by means of an endless drive cable. The latches are operated by a single manual actuator including a swiveling lever connected to one of the latches by a lost motion connection which allows the lever to be returned to a rest position after moving the latches into their latching or unlatching positions. A combination lock is provided for locking the actuator lever in the rest position except when the lock is on combination.

37 Claims, 19 Drawing Figures

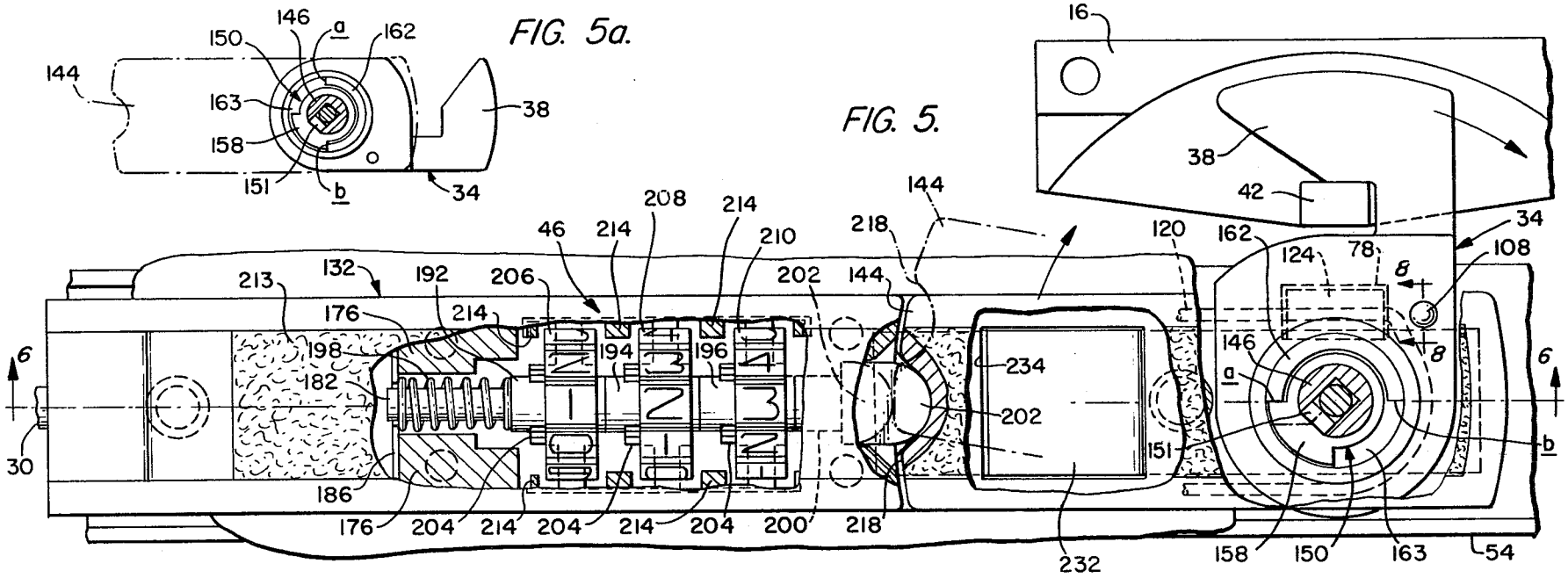
FIG. 5.
FIG. 5a.
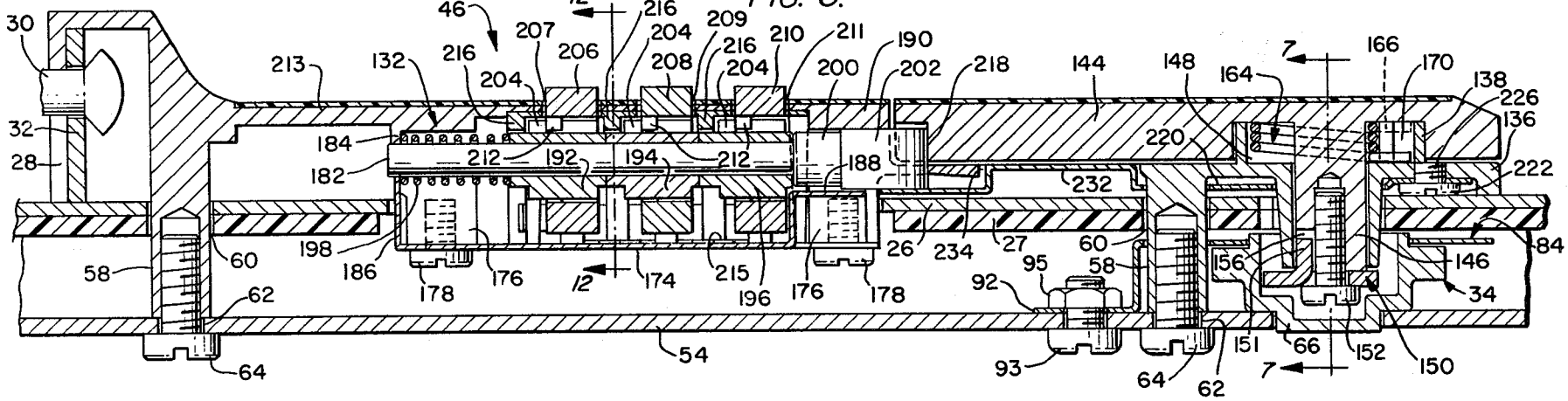
FIG. 6.

LATCHING SYSTEM FOR LUGGAGE ARTICLES

BACKGROUND OF THE INVENTION

This invention relates to a latching system suitable for use on a luggage article, particularly in a latching console which may be attached to one section of a luggage article, such as an attache case or the like, for releasably securing that section to another section of the article.

It is known to use a latching console, for example, on the front wall of a body section of an attache or like case, for releasably securing that section to a hinged lid of the case. Such consoles commonly include a central handle-mounting structure, a pair of spaced latch assemblies at opposite sides of the handle structure, respectively, for cooperation with fixed hasps or keepers on the hinged lid, and actuator means for moving the latch assemblies between latching and unlatching positions with respect to the hasps. The consoles may also include a locking means, frequently in the form of a combination lock or locks, for securing against unauthorized opening of the luggage article.

Various forms of latching consoles are known. The latching assemblies may, for example, include sliding or pivoting latches, and these may be operated individually by flip-up, swivel or sliding-type actuators. Alternatively, the latches may be linked together through the console for operation in unison by a single actuator, which may be positioned centrally of the console, and a single lock may be provided for preventing unauthorized operation of the actuator. Known latching consoles are shown, for example, in U.S. Pat. No. 3,555,860, to Atkinson, issued Jan. 19, 1971 and U.S. Pat. No. 3,961,505 to Gehrie et al., issued June 8, 1976, the latter being commonly assigned herewith.

There are various design criteria to be accommodated in latching consoles for luggage articles. Thus, for example, space considerations are a factor, and in particular the console mechanism should have a minimum thickness so as not to protrude unduly from the wall of the article to which it is attached. This consideration is of particular relevance in consoles where the latch assemblies are linked together for operation in unison and a linking mechanism must be included in the console. Further, the console mechanism should be simple to operate and reliable in operation.

The present invention is directed particularly toward a latching system which can be incorporated in a latching console for a luggage article with a view toward accommodating the above and other relevant criteria.

OBJECTS OF THE INVENTION

One object of the invention is to provide a latching system suitable for us in a latching console for attachment to a luggage article, wherein a novel mechanism is provided for operating a pair of spaced latches in unison.

Another object of the invention is to provide a novel form of actuator for a latching system having a swivel-type latch.

A further object of the invention is to provide a novel locking arrangement for a latching system particularly as applied to a latching console for use on a luggage article.

Another object of the invention is to provide a latching system for a luggage article which includes a single latch actuator and a lock for the actuator, the lock and actuator being convenient and simple to operate by a user.

Still another object of the invention is to provide a novel latching console for use on a luggage article.

Other objects of the invention will become apparent from the ensuing description and claims.

SUMMARY OF THE INVENTION

Briefly stated, the invention provides in one aspect a latching system, which may be incorporated in a latching console for attachment to a luggage article, and which employs a pair of spaced latches adapted to swivel in the general plane of the console between latching and unlatching positions, the latches being linked together through the console for operation in unison by a single actuator lever, which preferably also swivels in a plane parallel to the general plane of the console. The actuator lever may operate directly on one of the latches to move the latch between its latching and unlatching positions, with corresponding movement being transmitted to the other latch by a drive means extending through the console. Preferably the drive means may include an endless drive element, such as a wire cable, trained around hub or pulley portions of the respective latches and male elements fixed to the cable may engage corresponding female formations in the respective latch hubs to form positive drive connections. The cable may be twisted into a figure-8 configuration so that the latches swivel in opposite directions when operated.

The invention further contemplates, in another of its aspects, a lost motion connection between the actuator lever and the one latch whereby movement of the lever in one direction from a rest position is effective to move the latch from an unlatching to a latching position, the lost motion connection permitting return of the actuator lever to the rest position with the latch remaining in the latching position and movement of the actuator lever in the other direction from the rest position is effective to move the latch from the latching position to the unlatching position, the lost motion connection again permitting return of the lever to the rest position with the latch remaining in the unlatching position.

In still a further aspect, the invention contemplates a novel locking arrangement for the actuator lever. In this arrangement, a combination lock is provided with an axially movable elongate plug or shaft, having a nose portion projecting from the lock to provide a latch formation which engages a complementary catch formation at one end of the swivelling lever. The plug is spring biased into engagement with the catch formation on the actuator lever and swivelling movement of the lever produces a camming action between the catch formation and the nose portion of the plug, depressing the plug and freeing the actuator. Combination locking elements are provided between the plug and the lock casing to prevent the plug from being moved unless the lock is on combination, thereby preventing the actuator from being swivelled out of engagement with the plug. Further when the lock is on combination and the actuator lever is moved away from the plug, the plug may be depressed inwardly with respect to the lock casing into a position in which it allows the combination of the lock to be changed, and a stop may be provided for holding the plug in the combination-changing position.

Preferred embodiments of the invention are described below, by way of example, with reference to the accompanying drawings.

Figure 3:
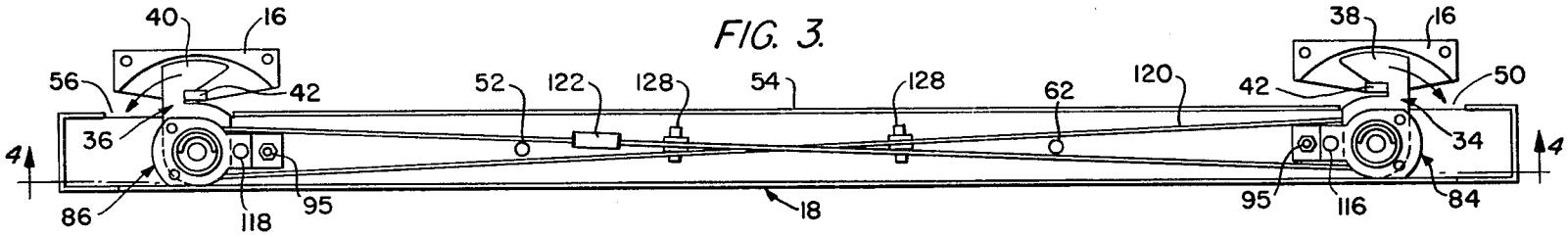
Figure 4:
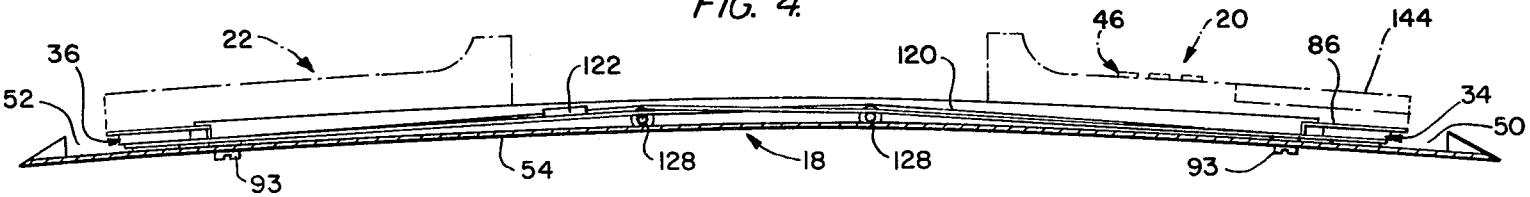

FIGS. *2a* and *2b* are respectively a rear elevational view and a side elevational view of one of the console latches;

FIG. 3 is a front elevational view of a section of the console which attaches interiorly of the luggage case;

FIG. 4 is a sectional view on line 4—4 of FIG. 3;

FIG. 5 is an outside elevational view, partly broken away, of a section of the console showing a combination lock, one of the console latches, a latch actuator and a hasp;

FIG. *5a* is a view showing the one latch in its unlatching position.

Figure 7:
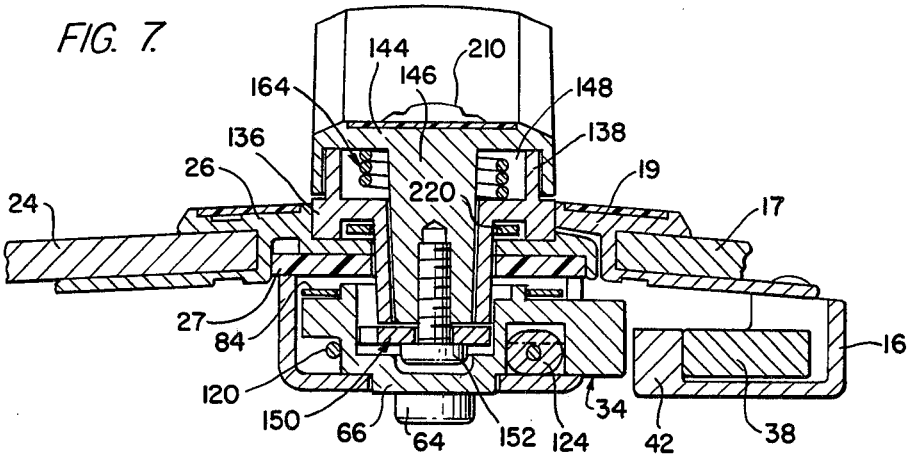
Figure 8:
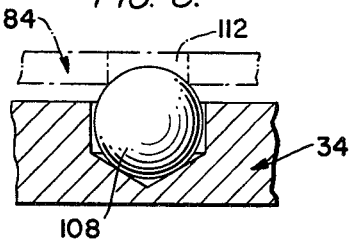
Figure 9:
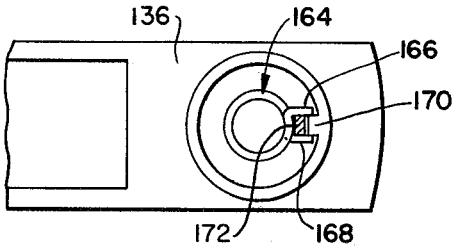
Figure 10:
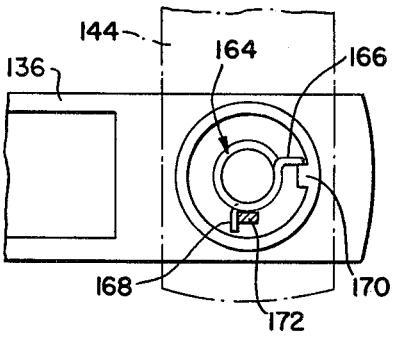
Figure 11:
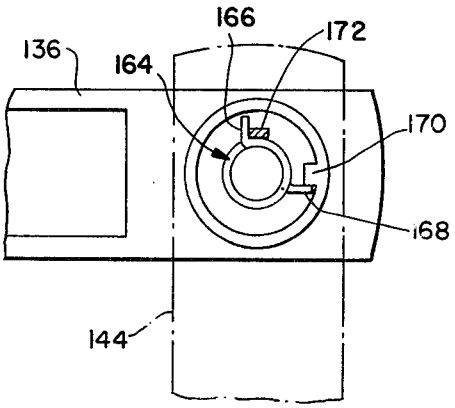
Figure 12:
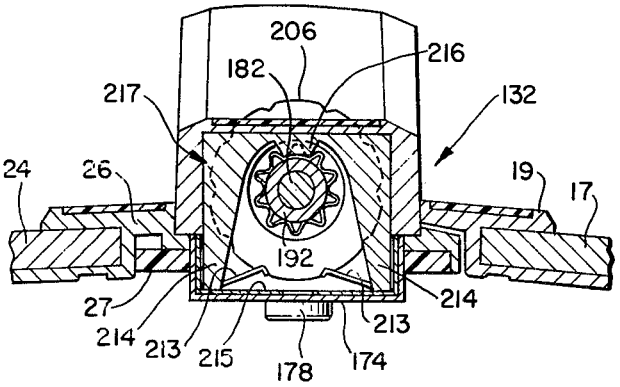
Figure 13:
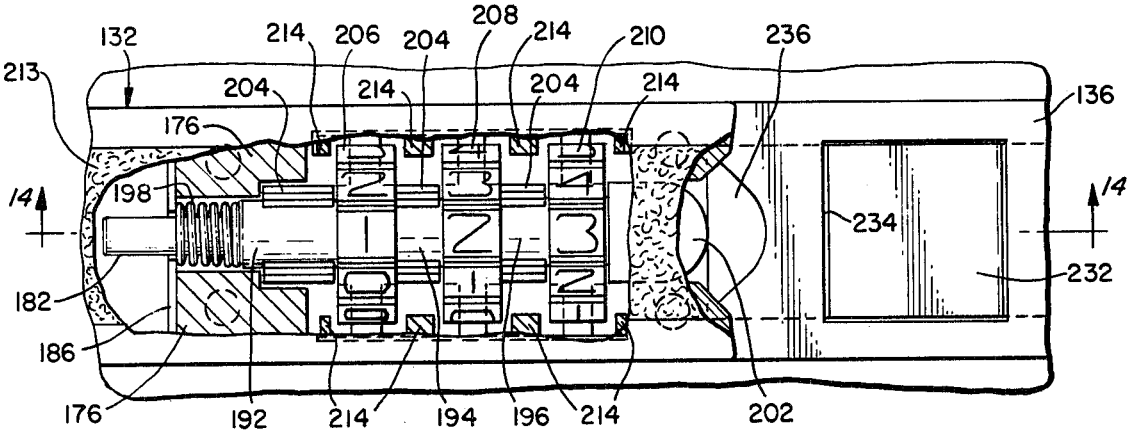
Figure 14:
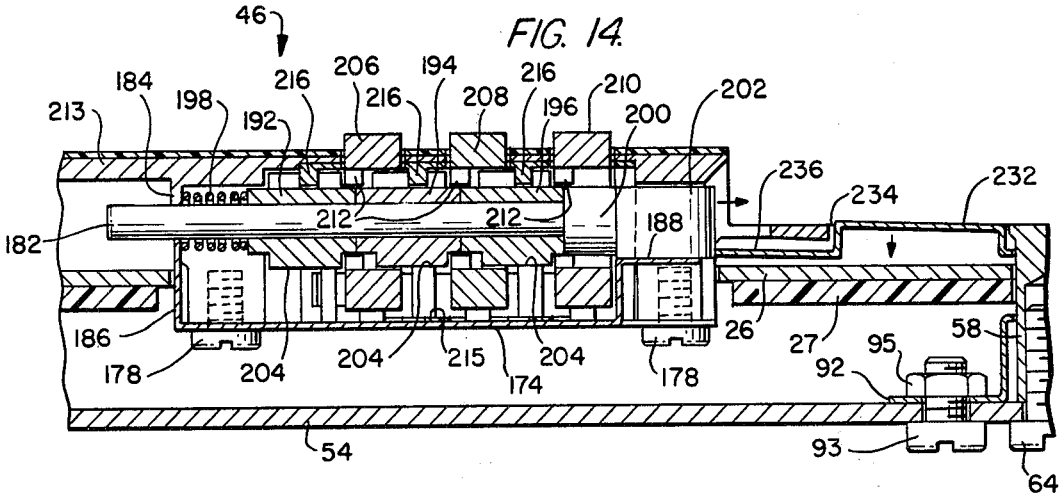
Figure 15:
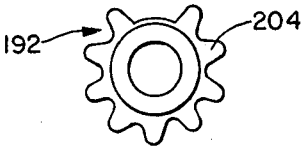

FIG. 6 is a sectional view on line 6—6 of FIG. 5;

FIG. 7 is a sectional view on line 7—7 of FIG. 6;

FIG. 8 is a sectional view on line 8—8 of FIG. 5;

FIGS. 9, 10 and 11 are partly diagrammatic views illustrating different positions of the actuator;

FIG. 12 is a sectional view on line 12—12 of FIG. 6;

FIG. 13 is a front elevational view, partly broken away, of the combination lock shown in a combination changing condition;

FIG. 14 is a sectional view on line 14—14 of FIG. 13;

FIG. 15 is an end elevational view of a combination sleeve; and

Figure 16:
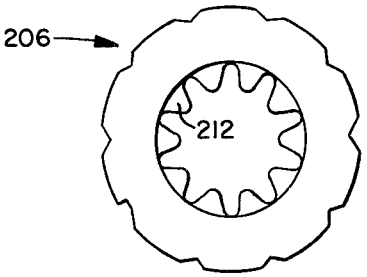

FIG. 16 is an end elevational view of a combination dial.

DESCRIPTION OF PREFERRED EMBODIMENTS

Figure 1:
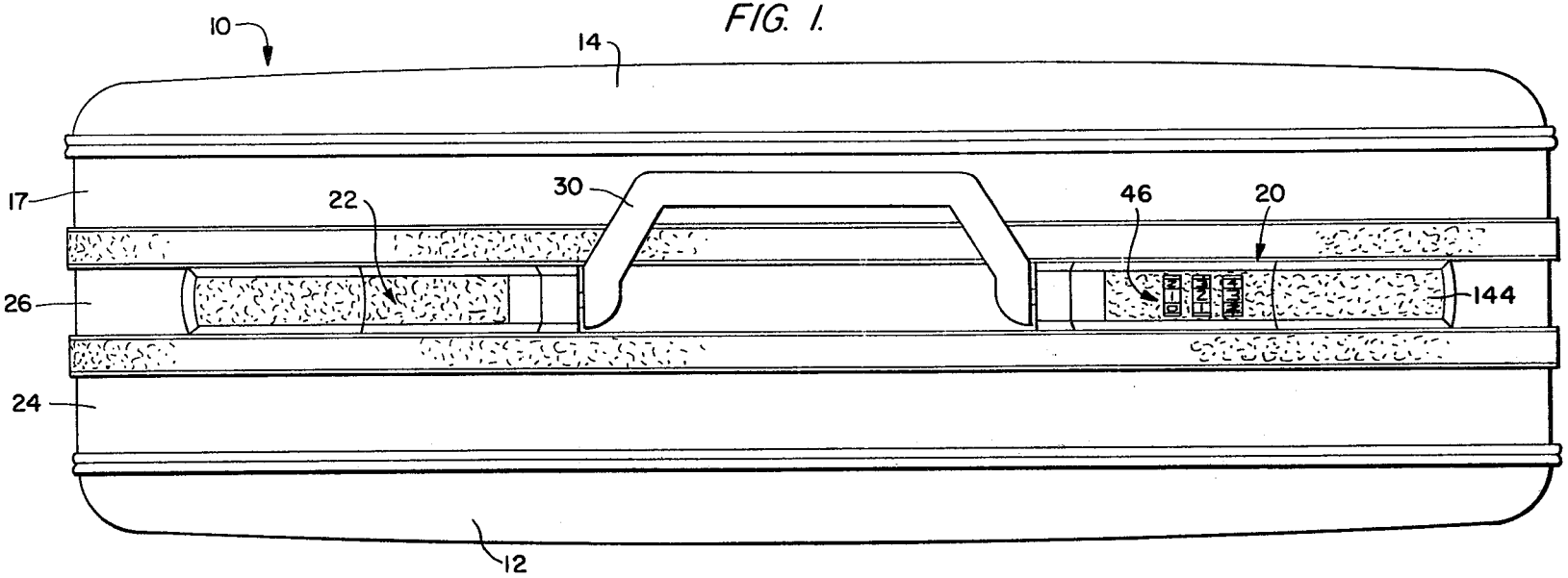
FIG. 1 is an outside front elevational view of a luggage case equipped with a latching console in accordance with the invention.
Figures 2, 2A, 2B:
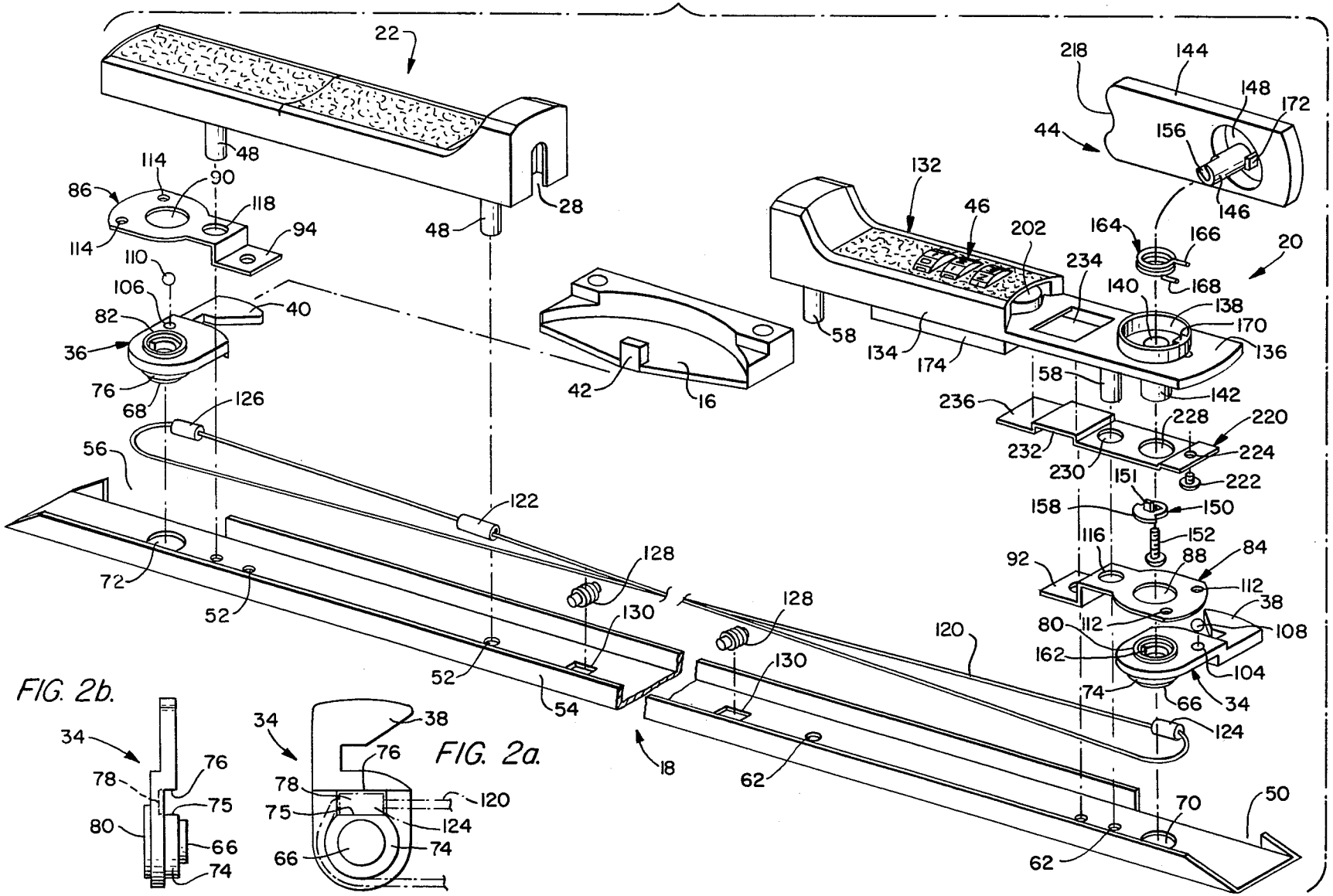
FIG. 2 is an exploded perspective view of the components of the latching console and showing a hasp with which one of the console latches cooperates.

A luggage case 10 (FIG. 1) utilizing the invention may include a body section 12 and a hinged lid 14 of conventional form. A latching console in accordance with the invention (see particularly FIGS. 2–4) may be attached to the front wall of body section 12 to releasably secure the case sections together in conjunction with hasps 16 which, in use, may be secured to the interior of a front wall 17 of hinged lid 14 of the case.

The latching console may include three main sections, namely, an elongate latch-carrying section 18 which is attached to the interior of body section 12, a lock and actuator assembly 20, and a dummy actuator 22, the last two components being mounted on the exterior of the body section 12 of the case.

Body section 12 has a front wall 24 with an upper portion 26 through which the console sections are attached together by means of fasteners passing through suitable openings in wall portion 26. Wall portion 26 may be formed integrally with the remainder of body section 12 of the case or alternatively as shown in the drawings particularly in FIG. 7, this wall portion may be a separate valance member, supplied as a component of the latching console, in which case it is attached in the conventional manner, for example by tongue and groove-type connections, to the rim of body section 12. Front wall 17 of lid 14 may have a complementary valance section 19 (FIG. 7) to which hasps 16 are attached. Assembly 20 and dummy actuator 22 may have recesses 28 in their adjacent end portions (see FIGS. 2 and 6) which serve to mount the ends of a conventional central carrying handle 30 with a washer 32 or the like being provided in each recess.

Latch-carrying section 18 of the latching console carries spaced swivelling latches 34, 36 adapted to swivel in planes parallel to the general plane of wall portion 26 and a drive mechanism (to be described) for providing swiveling movement of the latches in unison. The latches have hook portions 38 and 40 adapted to engage posts 42 of the respective hasps. The lock and actuator assembly 20 includes a manual actuator 44 for effecting swiveling movement of latch 34 (and through the drive mechanism corresponding movement of latch 36) and a combination lock 46 for locking the actuator and latches in position when the case is closed. Dummy actuator 22 serves only to mount one end of the handle 30 and to stabilize the latching console by connection to latch-carrying section 18. The dummy actuator may comprise an integral casting or molding of complementary shape to assembly 20 so as to give a balanced appearance to the luggage case. Internally threaded bosses 48 project from the rear surface of the dummy actuator through openings (not shown) in the wall portion 26 of the case and are aligned with openings 52 in base plate 54 forming part of latch-carrying section 18 of the console. Screws, also not shown fit in each of the bosses 48 to connect the dummy actuator to latch-carrying section 18. The lock and actuator assembly 20 also includes threaded bosses 58 extending through openings 60 in wall portion 26 (FIG. 6) and aligned with openings 62 in base plate 54. Screws 64 are received in the bosses 58 to connect assembly 20 to latch-carrying section 18. Rivets may, of course, be used instead of screw-type fasteners where appropriate.

Latch-carrying section 18 of the latching console (see particularly FIGS. 2–4) may be held in place on the interior of wall portion 26 by the connections formed between bosses 48 and 58 and their respective screws. Wall portion 26 may be channel shaped as seen in FIG. 7, and a reinforcing insert 27 may be provided. Section 18 of the latching console comprises the aforementioned base plate 54, which may be channel-shaped and have openings 50 and 56 in one upright wall to accommodate swiveling movement of the latches 34 and 36 between their latching and unlatching positions.

Latches 34 and 36 are each formed on their rear surfaces with a boss, 66 and 68 respectively, (see FIGS. 2, 6 and 7) which fits in a corresponding opening, 70 and 72 respectively, in base plate 54 to rotatably mount the latches on the base plate. Adjacent the respective bosses, each latch has a part-circular hub or pulley portion 74 and 76, respectively. Referring particularly to FIGS. *2a* and *2b*, it will be seen that hub portion 66 of latch 34 has a flat upper surface 75 facing a parallel flat surface 76 at the base of hook portion 38. Surfaces 75 and 76 define a channel therebetween and a shallow rectangular recess or pocket 78 is formed in the base of this channel. It will be understood that the rear of latch 36, while not shown in detail, has a corresponding channel and recess. The front surfaces of each of the latches 34 and 36 are formed with shallow cylindrical flanges 80 and 82, respectively. Cantilevered leaf springs 84 and 86 hold the respective latches in place on base plate 54 with central openings 88 and 90 in the respective springs rotatably receiving latch flanges 80 and 82. The springs are of stepped form and have base portions 92 and 94 through which they are attached to base plate 54 by means of screws 93 and 95 (FIGS. 3, 4 and 6). The front surfaces of latches 34 and 36 are further formed with shallow depressions 104, 106 which receive ball detents 108, 110. Springs 84 and 86 have openings 112 and 114 adapted to catch the respective balls 108 and 110 and releasably hold the latches when the latches are swiveled to their latching and unlatching positions, respectively, see FIG. 8. Springs 84 and 86 have further openings 116 and 118 for passage of bosses 58 and 48, respectively.

Swiveling motion is transmitted between the latches by drive means preferably in the form of endless wire cable 120, which may be formed from a wire of finite length having its respective ends connected by a crimp-type or other connection 122. The cable is twisted into a figure-8 configuration and is looped symmetrically over the hub portions 66 and 68 of the respective latches with the hub portions being received in each case between sections of the cable defining the respective loops. Further, the cable has male drive elements or plugs 124 and 126 crimped or otherwise fixed on the cable. Plug 124 fits in pocket 78 of latch 34 (see particularly FIGS. 2*a* and 5) and plug 126 fits in the corresponding pocket (not shown) in latch 36. The plugs 124 and 126 accordingly form a positive drive connection between cable 120 and the respective latches, and the twist in the cable produces swiveling movement of the latches in opposite senses respectively. Thus, as seen for example in FIG. 3, when latch 34 is swiveled in a clockwise direction from the illustrated latching position to its unlatching position in which it is received in base plate 54, swiveling movement will be transmitted through the cable 120 to latch 36, which moves in the counterclockwise direction from the illustrated latching position to the unlatching position, in which this latch is likewise received in base plate 54. Roller guides 128 located in openings 130 in base plate 54 may be provided for guiding cable 120.

Swiveling movement is imparted directly to latch 34 (and through drive cable 120 to latch 36) by means of the manual actuator 44 forming part of actuator and lock assembly 20 and which will now be described.

Assembly 20 may include an integral member 132 having a housing portion 134 and a base plate protion 136. The aforementioned bosses 58 project from the undersurface of member 132. Base plate portion 136 has on its upper surface a cylindrical flange 138, and a bore 140 extends through portion 136 and through a boss 142 projecting from the undersurface of portion 136. The manual actuator includes an actuator lever 144 with a depending post 146 received in bore 140 and a cylindrical recess 148 fitting over flange 138. Post 146 is internally threaded, and a segment plate 150 is attached to the base of post 146 by a screw 152. Segment plate 150 includes an upstanding tab 151 fitting in a cut-away portion 156 of post 146, as best seen in FIGS. 5 and 6, so that the segment plate is constrained to swivel with the lever 144. Lever 144 and segment plate 150 together define the manual actuator. As best seen in FIGS. 5 and 5*a*, the segment plate has a segment portion 158 extending over a 90° quadrant. Segment plate 150 fits in a circular recess 160 in latch 34, this recess including a semicircular wall 162, the opposite edges of which define a semicircular opening 163 in which the segment portion is received and which edges are adapted to engage the opposite edges of segment portion 158 respectively, as will be described.

The configuration of segment portion 158 and wall 162 is such that when latch 34 is in the latching position, as shown in FIG. 5, and lever 144 of the actuator is in its rest position (the longitudinal axis of the lever being aligned with the longitudinal axis of base plate 54) one edge of segment portion 158 engages the edge a of wall 162. If the manual actuator lever 144 is now swiveled in a clockwise direction, segment portion 158 causes latch 34 also to swivel in a clockwise direction by engagement of segment portion 158 and edge a of wall 162. (Corresponding counterclockwise rotation is imparted to latch 36 through cable 120). When latch 34 has swiveled through 90° to the unlatched position shown in FIG. 5*a*, the actuator may be returned to the rest position by virtue of the relative lengths of the arcs of segment portion 158 and opening 163. During such movement segment portion 158 moves away from edge a of wall 162. The manual actuator lever 144 can thus be returned to the rest position illustrated in FIG. 5*a* while latch 34 is retained in the unlatching position shown in that figure. In the condition shown in FIG. 5*a*, segment portion 158 engages edge b of wall 162. It will be appreciated, that in order to move the latch from the unlatching position to the latching position, the actuator lever 144 is swiveled from the FIG. 5*a* condition in a counterclockwise direction, returning latch 34 to the position shown in FIG. 5. By virtue of the configuration of segment portion 158 and wall 162, the actuator may again be returned to the rest position without disturbing latch 34. Thus, a lost motion connection is formed between the actuator and the latch whereby the latch is swiveled generally in the plane of the latching console between its latching and unlatching positions by means of an actuator lever which swivels in a parallel plane and can be returned to its rest position independently of the latch. It will also be apparent that in the unlatching position, latches 34 and 36 are received within base plate 54 and are therefore concealed behind wall portion 26 of the case, while in the latching position, the latches are projected from wall portion 26 to engage with hasps 16.

The actuator is preferably provided with means for biasing the actuator to return to the rest position when it has been swiveled in either direction to operate the latches. This means includes a coil spring, 164, of the "scissors" type, the opposite ends of which are bent to form spaced, generally radial limbs 166 and 168, the spring being received in an annular space defined between post 146 and flange 138. Further, flange 138 has an internal projection 170, and lever 144 has a tab 172, projecting into recess 148 and positioned slightly closer to the axis of post 146 than projection 170. Limbs 166 and 168 of spring 164 straddle tab 172 and projection 170 when the actuator is in the rest position as shown in FIG. 9. When the actuator is swiveled in either direction from the rest position, as shown in FIGS. 10 and 11, tab 172 will move one or other of the limbs 160 and 162, thereby separating the limbs, tensioning spring 164, and biasing the actuator to return to the rest position.

Combination lock 46 may be employed to prevent the actuator from being swiveled from the rest position (when latches 34 and 36 are in engagement with hasps 16) except when the lock is on combination. The construction of the combination lock will now be described with particular reference to FIGS. 5, 6 and 12–16.

Lock 46 includes a casing comprising the previously referred-to housing portion 134 of member 132 and a back cover plate 174 attached to posts 176 on the undersurface of member 132 by screws 178 which fit in suitable openings in the cover plate (not shown) and threaded bores 180 in posts 176. Internally of the lock casing there is provided an elongate plug or shaft 182 supported at its left-hand end between a projection 184 of member 132 and an upturned end 186 of cover plate 174. At its right end, shaft 182 is supported between a raised central portion 188 of the cover plate and a bearing portion 190 of member 132. Shaft 182 carries combination sleeves 192, 194 and 196 situated between resilient biasing means in the form of a coil spring 198 surrounding the left end of the shaft and an integral shaft collar 200 adjacent the other end of the shaft. To the right of shaft collar 200, shaft 182 terminates in a flattened nose portion 202 having a curved end profile as seen in FIG. 5. By this construction, spring 198 urges the assembly of shaft and sleeves to the right as shown in FIGS. 5 and 6 so that nose portion 202 projects from the housing portion of member 132 through an opening formed between bearing portion 190 and cover plate 186.

Combination sleeves 192, 194 and 196 each have a series of peripheral teeth 204 with one tooth being omitted in each case, (See FIG. 18). The sleeves further have plain portions absent of teeth at their left and right ends. Combination dials 206, 208, 210 encircle the sleeves, respectively, and are coupled for rotation with the sleeves by dial teeth 212 meshing with the teeth of the respective sleeves. As seen particularly in FIGS. 6 and 14, the dial teeth extend only partway over the thickness of the dials. On their exterior periphery, the dials carry a circumferential series of combination indicia with detents therebetween which engage the arms 213 (see FIG. 12) of a dial spring 215 so that the dials and sleeves can be indexed around shaft 182 into different combination settings. The dials have peripheral portions projecting in conventional manner through openings 207, 209, 211 in an upper wall or faceplate portion 213 of the lock housing. The lock housing further includes a bridge member 217 (see FIG. 12) having a series of limbs 214 disposed adjacent the respective dials. The bridge member further includes a series of blocking formations 216 disposed to align with the spaces defined by the omitted teeth of the respective sleeves.

Shaft 182 is biased by spring 198 into a position in which nose portion 202 projects from housing portion 134. Further, nose portion 202 defines a latch formation adapted to engage a complementary catch formation formed at the free end of lever 144 when the lever is in the rest position. For this purpose, the free end of lever 144 is formed as a cam surface 218 complementary to the profile of nose portion 202, which forms a cooperative cam surface.

In the rest position of lever 144, the longitudinal axis of the lever aligns with the longitudinal axis of shaft 182 and the cam surfaces on the lever and on nose portion 202 are in mating engagement whereby lever 144 is held in the rest position.

When the dials and sleeves of the lock are set on combination, the condition is such that the space defined by the omitted teeth of each of the sleeves 192–196 aligns with the blocking formations 216. In this condition, the lock is unlocked and shaft 198 can be pressed to the left as shown in FIGS. 5 and 6 against the bias of spring 98. Accordingly, lever 144 can be swiveled from the rest position, such movement being accompanied by a camming action between the respective cam surfaces 202, 218 causing depression of shaft 182 inwardly with respect to the lock casing against spring 198 to an unlatching position in which lever 144 is released from nose portion 202 by camming shaft 182 to the left. When, however, the dials of the lock are off combination, one or more of the sleeve teeth 204 align with blocking formations 216 thereby preventing the shaft from being depressed to the left against spring 198. Therefore in this, the locked condition of the lock, when lever 144 is in the rest position in engagement with nose portion 202 (as is the situation when latches 134 and 136 are engaged with hasps 16), nose portion 202 cannot be moved to the left, and the lever 144 cannot therefore be disengaged from nose portion 202 by the above described camming action. This prevents the actuator from being operated, and the case cannot be opened.

The lock also includes a means for changing the combination to one of a user's own particular choice. To effect a combination change, the lock must first be placed on combination. Then the user moves actuator lever 144 away from its rest position and presses on nose portion 202 of shaft 182 to move it to the left with respect to housing portion 134 beyond the unlatching position, to a position at which the respective dial teeth 212 are disengaged from the respective sleeve teeth, and the dials may be turned relative to the sleeves (the sleeves being held in position by the blocking formations 216). This condition is shown in FIGS. 16 and 17. In the normal movement of shaft 182 when lever 144 is swivelled, shaft 182 does not move sufficiently to disengage the teeth of the sleeves from the teeth of the dials. It will be noted that the base plate portion 136 of member 132 carries a leaf spring 220 attached to the undersurface of the base plate portion by a screw 222 passing through an opening 224 in the spring and into a threaded opening 226 in the base plate portion. The spring has further openings 228 and 230 (FIG. 2) for passage of posts 142 and boss 58, respectively, A raised portion 232 of spring 220 fits in a corresponding opening 234 in the base plate portion, and the left end portion 236 of the spring fits under nose portion 202 of shaft 182 as shown particularly in FIG. 6. Spring 220 is biased upwardly as shown in FIG. 6 and during normal camming movement of the shaft 182 by the manual actuator lever 144 nose portion 202 of the shaft rides on end portion 236 of the spring.

When the shaft 182 is depressed far enough into housing portion 134 to change the combination of the lock, as shown in FIGS. 16 and 17, the nose portion moves beyond the left end of spring 220, allowing the spring to flip up into the position shown in FIG. 17. The left edge of the spring, in this position, forms a stop member which holds shaft 182 in its depressed condition during rotation of one or more of the dials relative to the corresponding sleeve or sleeves. When the combination has been changed, raised portion 232 of the spring, which forms a release means for the shaft, can be depressed so that the shaft snaps back to the right under the influence of spring 198 into its normal operating position, thereby bringing the dials and sleeves back into coupling engagement and setting the new combination.

It will be seen from the foregoing that the invention provides a latching system particularly suitable for use on an article of luggage. The system employs a pair of spaced latches linked by a compact and relatively flat, simple drive system for swiveling movement in unison and a readily accessible actuator for operating the latches in unison. The use of an endless cable for moving the latches in unison avoids the necessity for complex linkages which is of particular advantage where the latches, operated by a single actuator are relatively widely spaced apart. This form of latch drive system moreover permits of ready adaptation to different size cases and facilitates adjustments to compensate for hasp spacing tolerances.

Further, the invention provides a compact combination lock arrangement for locking the actuator in position to inhibit its unauthorized use. The lock and actuator may be located in juxtaposition to one side of a central carrying handle of a luggage article and can be conveniently operated by a user with one hand, while for example, the carrying handle is held in the other hand.

While only preferred embodiments of the invention have been described herein in detail, it will be understood that the invention is not limited thereby and modifications can be made within the scope of the attached claims. For example, while a specific form of combination lock having an axially moving plug has been discribed for locking the actuator lever, other forms of locking mechanism may be used for this purpose.

I claim:

1. In a latching system for a luggage article, comprising a pair of spaced latches, means mounting each of said latches for reversible swiveling movement between latching and unlatching positions, drive means connecting said latches for swiveling movements in unison between the respective latching and unlatching positions and for reverse swiveling movements in unison between the respective unlatching and latching positions, and a manual actuator for operating the latches in unison, the improvement wherein said drive means includes a pulley portion formed on each of said latches and an endless drive element looped around the respective pulley portions.

2. The improvement as defined in claim 1, wherein said drive element is twisted between the latches into a figure-8 configuration whereby said latches are swiveled in opposite senses respectively when operated.

3. The improvement as defined in claim 1 or claim 2 including positive drive connections between said endless element and the respective latches.

4. The improvement as defined in claim 3 wherein each of said drive connections comprises a male drive element fixed on said endless element and a recess formed in the pulley portion of the respective latch, said recesses receiving said drive elements.

5. The improvement as defined in claim 1 or claim 2, wherein said endless drive element is formed of a wire cable.

6. The improvement as defined in claim 1 or claim 2, wherein said actuator is connected to one of said latches.

7. The improvement as defined in claim 6, wherein said actuator includes an actuator lever adapted to swivel in a plane substantially parallel to a plane containing one of said latches and connection means between said lever and said one latch.

8. The improvement as defined in claim 7, wherein said connection means includes a lost motion connection for translating movement of said lever in one direction from a rest position into movement of said one latch from its unlatching position to its latching position, said lost motion connection permitting return of the lever to the rest position while the latch is retained in its latching position, and for translating movement of said lever in the opposite direction from the rest position into movement of said one latch from its latching position to its unlatching position, said lost motion connection permitting return of the lever to the rest position while the latch is retained in its unlatching position.

9. The improvement as defined in claim 8, including spring means for returning said lever to the rest position when said lever is moved from the rest position in either one of said directions.

10. The improvement as defined in claim 8, wherein said system further includes a lock for locking said actuator lever in the rest position except when the lock is open.

11. The improvement as defined in claim 10, wherein said lock includes a spring biased plug terminating in a latch formation adapted to engage a complementary catch formation on said actuator lever to hold the lever in rest position, said latch and catch formations defining respective cam surfaces adapted to cooperate to depress said plug against the spring bias for moving said formations into and out of engagement by movement of the lever relative to the plug when the lock is open.

12. In a latching system for a luggage article including a latch, means for mounting said latch on a wall portion of the article for reverse swiveling movement in a plane substantially parallel to the general plane of said wall portion between a latching position and an unlatching position, a manual actuator for moving said latch between said positions, said actuator including an actuator lever, means for mounting said lever on said wall portion for swiveling movement substantially coaxially with said latch in a plane substantially parallel to the plane of swiveling of the latch and a lost motion connection between said lever and said latch for translating movement of said lever in one direction from a rest position into movement of the latch from its unlatching to its latching position, said lost motion connection permitting return of the lever to the rest position while the latch is retained in its latched position, and for translating movement of the lever in the opposite direction from the rest position into movement of the latch from its latching to its unlatching position, said lost motion connection permitting return of the lever to the rest position while the latch is retained in its unlatching position.

13. A system as defined in claim 12, wherein said lost motion connection includes a segment plate on said lever, a recess in said latch receiving said segment plate, said recess including a wall having an opening accommodating a segment portion of said plate, said opening extending over a part-circular arc and said segment portion extending over a smaller part-circular arc than said opening.

14. A system as defined in claim 13, wherein said opening extends over an arc of about 180° and said segment portion extends over an arc of about 90°.

15. A system as defined in claim 12, including spring means for returning said lever to the rest position when the lever is moved therefrom in either one of said directions.

16. A system as defined in claim 15, wherein said spring means comprises a scissors-type coil spring encircling a post of said lever, said coil spring having spaced, generally radially extending limbs at its opposite ends, said limbs in the rest position of the lever straddling a tab on said lever adjacent said post and further straddling a projection on a member on which said lever swivels, movement of said lever in either direction from the rest position effecting relative separation of said tab and said projection thereby separating said limbs and tensioning the spring.

17. A system as defined in claim 12, including a combination lock for locking said lever in the rest position except when said lock is on combination.

18. A system as defined in claim 17, wherein said lock includes a movable plug terminating in a latch formation adapted to engage a complementary catch formation on said actuator lever, said formations defining cam surfaces adapted to cooperate for engaging and disengaging the respective latch and catch formations by relative movement of the lever and plug when the lock is on combination.

19. A system as defined in claim 12, including a further latch, means for mounting said further latch on said wall section for reverse swiveling movement between latching and unlatching positions in a plane substantially parallel to the general plane of said wall portion, and drive means connecting said latches for swiveling movements in unison between their respective latching and unlatching positions.

20. A system as defined in claim 19, wherein said drive means includes an endless drive element looped around pulley portions of the respective latches.

21. A latching system for a luggage article including a latch, a swiveling actuator lever for moving said latch between latching and unlatching positions and a lock for releasably locking said lever in a rest position, said lock including a movable plug member terminating in a latch formation adapted to engage a complementary catch formation on said lever to hold the lever in the rest position and resilient biasing means urging said plug member toward a position in which said latch formation is adapted to engage said catch formation, said latch and catch formations defining corresponding cam surfaces adapted to cooperate for moving said formations into and out of engagement only when the lock is unlocked by manual movement of said lever to and from the rest position accompanied by camming movement of said plug member against said resilient biasing means.

22. A system as defined in claim 21 wherein said lock is a combination lock and said plug can only be moved against said resilient biasing means when the lock is on combination.

23. A system as defined in claim 22, wherein said plug comprises an elongate member having said latch formation at one end and said lever has a swivel axis adjacent one end thereof and said catch formation at the other end thereof, said elongate member and said lever having longitudinal axes which align substantially when said formations are in mutual engagement.

24. A system as defined in claim 23, wherein said elongate member comprises a shaft carrying axially disposed combination lock sleeves, each sleeve having a surrounding combination dial coupled to the sleeve for rotation therewith about the longitudinal axis of said shaft.

25. A system as defined in claim 24, wherein said latch formation has a normal operative position wherein it projects from a lock casing and said latch formation is manually movable into said casing when the lock is on combination and said lever is moved from the rest position, sufficient to uncouple said sleeves from said dials whereby the lock's combination can be changed.

26. A system as defined in claim 25, including a stop member adapted to engage the end of said latch formation when the latch formation is depressed into said housing for holding said shaft in a position wherein said sleeves are uncoupled from their respective dials.

27. A system as defined in claim 26, including a release means for said stop member for disengaging said stop member from said latch formation whereby said latch formation can be returned to the normal position, said release means being covered by said actuator lever when said latch and catch formations are in mutual engagement.

28. In a luggage article latching system, a pair of spaced latches, means mounting each of said latches for movement between latching and unlatching positions, drive means connecting said latches for movement in unison between their latching and unlatching positions, a manual actuator lever, and connection means between said lever and one of said latches for translating movements of said lever in opposite directions from a rest position into movements of the latches between the latching and unlatching positions and between the unlatching and latching positions, respectively, said connection means permitting said lever to return to the rest position independently of said latches, the system including a combination lock for retaining said lever in the rest position except when the lock is on combination, wherein said lock includes a plug terminating in a latch formation adapted to engage a complementary catch formation on said lever to lock said lever in said rest position, said formation defining cam surfaces adapted to cooperate for disengaging and reengaging said formations when the lock is on combination by movement of said lever from said rest position accompanied by depression of said plug against a resilient biasing means.

29. A system as defined in claim 28, wherein said latches are mounted for planar swiveling movements between their respective latching and unlatching positions and said lever is mounted for swiveling movement in a plane substantially parallel to the plane of movement of said one latch.

30. In a luggage article latching system, a pair of spaced latches, means mounting each of said latches for movement between latching and unlatching positions, drive means connecting said latches for movement in unison between their latching and unlatching positions, a manual actuator lever, and connection means between said lever and one of said latches for translating movements of said lever in opposite directions from a rest position into movements of the latches between the latching and unlatching positions and between the unlatching and latching positions, respectively, said connection means permitting said lever to return to the rest position independently of said latches, wherein said drive means includes a pulley portion on each of said latches and an endless drive element looped around said pulley portions.

31. In a luggage article latching system, a latch-carrying assembly for mounting on the interior of a wall portion of one section of the article, and a combined lock and actuator assembly for mounting on the exterior of said wall portion, said latch-carrying assembly including a pair of spaced latches mounted for movement between latching and unlatching position on opposite sides of a central carrying handle of the article respectively, and drive means connecting said latches for movement in unison between their respective latching and unlatching positions, said combined lock and actuator assembly including a manual latch actuator for operating one of said latches by manual movement of said actuator from a rest position and thereby operating the other of said latches through said drive means, said combined assembly including a lock having a movable plug and locking means for the plug, the plug being adapted to engage the actuator for releasably locking the actuator in said rest position, said lock and actuator being located to one side of said carrying handle of the article.

32. A system as defined in claim 31, wherein said latches are mounted for swiveling movement between the latching and unlatching positions, the latches in their respective unlatching positions being adapted to be concealed behind said wall portion and in their respective latching positions being adapted to project from said wall portion for engagement with a pair of hasps on another section of the luggage article.

33. A system as defined in claim 32, wherein said actuator includes an actuator lever adapted to swivel in opposite directions respectively from a rest position for moving said latches from their latching positions to their unlatching positions and vice versa, and wherein said lock comprises a combination lock, said plug being movable to release said lever for movement from the rest position only when the lock is on combination.

34. A combination lock comprising a casing, a shaft axially movably mounted in said casing, a nose portion at one end of said shaft defining a latch formation for engaging a member to be locked, said shaft having a latching position in which the nose portion projects from the casing, combination locking means for releasably locking the shaft in said latching position, the shaft being moveable axially from said latching position to an unlatching position only when said combination locking means is on combination by movement of said nose portion inwardly with respect to said casing, and the shaft being moveable axially beyond said unlatching position when the locking means is on combination by further movement of said nose portion inwardly with respect to said casing to move the shaft into a position in which the combination of said locking means can be changed.

35. A combination lock as defined in claim 34 including resilient biasing means urging the shaft toward the latching position and a stop member adapted to engage the outer end of said nose portion when the shaft is in said position in which the combination can be changed for holding the shaft in said position against the action of said biasing means.

36. A combination lock as defined in claim 35 wherein said stop member comprises a portion of a leaf spring over which said nose portion fits when the shaft is in said latching and unlatching positions, and which springs into a shaft-holding position when cleared by said nose portion.

37. A combination lock as defined in claim 36 wherein said leaf spring has a depressable portion for releasing said stop member and permitting the shaft to return to said latching position under the influence of said resilient biasing means, said depressable portion being covered by the member to be locked when said member is in engagement with said latch formation.

* * * * *